US005945871A

United States Patent [19]

Kausel et al.

[11] Patent Number: 5,945,871

[45] Date of Patent: Aug. 31, 1999

[54] PROCESS FOR TEMPERATURE STABILIZATION

[75] Inventors: Wilfried Kausel; Johann Kremser, both of Vienna, Austria; Rumen Peev, BG-Sofia, Bulgaria

[73] Assignee: National Semiconductor Corporation, Santa Clara, Calif.

[21] Appl. No.: 08/765,282

[22] PCT Filed: Jun. 16, 1995

[86] PCT No.: PCT/AT95/00120

§ 371 Date: Feb. 26, 1997

§ 102(e) Date: Feb. 26, 1997

[87] PCT Pub. No.: WO96/03682

PCT Pub. Date: Feb. 8, 1996

[30] Foreign Application Priority Data

Jun. 24, 1994 [AT] Austria ..... 1258/94

[51] Int. Cl.[6] ..... G05F 1/10

[52] U.S. Cl. ..... 327/538; 327/539; 327/545; 327/540

[58] Field of Search ..... 327/538, 539, 327/540, 541, 543, 545; 323/313

[56] References Cited

U.S. PATENT DOCUMENTS

| | | | |
|---|---|---|---|
| 3,743,850 | 7/1973 | Davis . | |
| 4,249,122 | 2/1981 | Widlar | 323/313 |
| 4,375,595 | 3/1983 | Ulmer et al. | 327/539 |
| 4,584,492 | 4/1986 | Sharp | 327/541 |
| 4,845,388 | 7/1989 | Amatangelo | 327/541 |
| 5,053,640 | 10/1991 | Yum . | |
| 5,059,820 | 10/1991 | Westwick . | |
| 5,291,122 | 3/1994 | Audy . | |
| 5,352,972 | 10/1994 | Pernici et al. | 323/313 |
| 5,541,551 | 7/1996 | Brehner et al. | 327/539 |
| 5,563,504 | 10/1996 | Gilbert et al. | 323/316 |
| 5,731,733 | 3/1998 | Denham | 327/525 |
| 5,773,967 | 6/1998 | Tenten | 323/313 |

FOREIGN PATENT DOCUMENTS

WO 82/0206 8/1982 WIPO .

OTHER PUBLICATIONS

Germano Nicollini and Daniel Senderowicz, A CMOS Bandgap Reference for Differential signal processing, IEEE Journal of Solid–Stae Circuites, Jan. 26, 1991.

O. Salminen and K. Halonen, The High Order Temperature Compensation of Bandgap Voltage References, Helsinki University of Technology, May 10, 1992.

*Primary Examiner*—Terry D. Cunningham
*Attorney, Agent, or Firm*—Limbach & Limbach LLP

[57] ABSTRACT

In a method of temperature stabilization of a reference voltage, in a first prespecified time interval, a current having a first constant amperage and, in a second prespecified time interval, a current having a second constant amperage and alternately applied to a pn junction. During the first and second time intervals, voltages at the pn junction are supplied to an input of an analysis circuit. The analysis circuit forms the difference between the two voltages and adds the difference in a weighted manner to a voltage obtained from one of the first and second amperages. The weighted result is applied to an output of the analysis circuit. The first constant amperage is applied to the pn junction during both the first and second prespecified time intervals and the second constant amperage is applied to the pn junction during the second prespecified time interval.

7 Claims, 7 Drawing Sheets

PROCESS FOR TEMPERATURE STABILIZATION

BACKGROUND OF THE INVENTION

1. Field of the Invention

The present invention is directed to a process for temperature stabilization of a reference voltage and, in particular, to a process in which, in a first time interval, a current with a first amperage and, in a second time interval, a current with a second amperage are alternately provided to a diode or pn junction, preferably the base-emitter diode of a bipolar transistor. During the first and second time intervals, the voltages at the diode or the pn junction are supplied to the input of an analysis circuit. In the analysis circuit, the difference between the two voltages obtained through the first and the second amperages is formed and added in a weighted manner to the voltage obtained through one of the two amperages. The result is then provided as the output of the analysis circuit.

2. Description of the Related Art

Bandgap reference processes based on the principle of temperature compensation through weighted addition of two voltages U1 and U2 with opposing temperature coefficients are well known. The weighting factors K1 and K2 are chosen in such a way that the effects on these voltages due to the temperature T mutually cancel each another. The reference voltage Uref is thus represented as follows:

$$Uref=K1U1(T)+K2U2(T)$$

U.S. Pat. No. 5,059,820 discloses a circuit configuration in accordance with such a known bandgap reference process in which, for temperature stabilization of a reference voltage, two different amperages are alternately provided, by means of two synchronized current sources, to a single pn junction formed by the base-emitter diode of a bipolar transistor. The voltage drop at the pn junction is supplied to an analysis circuit. In this way, owing to the use of only one diode, it is not necessary to take into account variation or scatter of the characteristic data of a second diode. It is thereby possible to greatly reduce the scatter of the absolute value of the reference voltage as well as its temperature dependence. A particular advantage of this process is that it is only weakly dependent on resistance relations and current density relations.

PCT Patent Application WO 82/02806 discloses that, for the voltages U1 and U2 with opposed temperature effect, it is known to use the voltage drop $U_{be}$ at the base-emitter diode of a bipolar transistor, given the current density and the voltage difference $DU_{be}$ between these and the base-emitter diode of another bipolar transistor, to which a different amperage is applied. The weighted addition of the voltages U1 and U2 occurs in an analysis circuit by means of an operational amplifier connected to resistors.

The drawbacks of this process lie, first, in the use of at least two base-emitter diodes, since very different results can thereby be obtained due to scatter of the characteristic data, and, second, in the poor implementation of the process in the case of integrated circuits in CMOS technology, since the resistors of the analysis circuit in this technology cannot be fabricated with adequate precision.

SUMMARY OF THE INVENTION

The above-discussed problems are overcome in accordance with the present invention by applying a first constant amperage to a diode or ph junction during both first and second prespecified time intervals and by applying a second constant amperage during the second prespecified time interval in addition to the first amperage.

In further accordance with the invention, in the analysis circuit, the voltage that is applied to the diode during one of the time intervals is read and, during subsequent time interval is stored. In this way, it is possible to accomplish in a simple way the weighted addition of the voltage or voltage difference that is successively present.

The invention also provides a circuit configuration for carrying out the process. A drawback of known circuit configurations is the deterioration of the temperature stability through the offset voltage, which is mostly temperature dependent as well, in the operational amplifier used in the analysis circuit. A circuit configuration in accordance with the invention makes possible an automatic offset compensation and is realizable in the form of integrated circuits, in particular, in CMOS and MOS technology.

This is achieved, in accordance with the invention, by connecting a first current source and a synchronized second current source that supplies any multiple of the current of the first current source, preferably an integral multiple, to a transistor operating as diode and by connecting this circuit junction with the input to an analysis circuit. In this way, it is possible to realize quite well the application of two different amperages to only one base-emitter diode. Through the use of only one diode, the dependence with respect to temperature and the scatter of the characteristic data for the second diode are obviated.

According to a further feature of the invention, the synchronized current source is formed through a current source connected in series with a synchronized switch. This allows a simple realization of a synchronized current source in CMOS technology as well.

According to an alternative embodiment of the invention, the emitter terminal of the transistor is connected through a synchronized switch to a terminal of a holding capacitor and to the input of a high-ohmic voltage amplifier. The output of this amplifier is connected through a resistor to the inverting input of an operational amplifier, which is connected through a resistor to the output of the operational amplifier. The emitter terminal of the transistor is connected through a resistor to the noninverting input of the operational amplifier, which is connected through a resistor to common ground. In this way, the voltage of the base-emitter diode of the transistor that appears during a time interval is stored in the holding capacitor so that, in the subsequent time interval, this voltage can be used for weighted addition, through the operational amplifier, with the voltage at the base-emitter diode present during this time interval. The resistors can be made up of capacitors operating as a switched capacitor circuit. In this way, the capacitors, which can be fabricated in CMOS technology more easily and with higher precision, replace the substantially less accurate resistors that are otherwise required for weighted addition and, thus, allow a much more precise reference voltage.

According to a further feature of the invention, the emitter of the transistor connected to the two current sources is connected through a capacitor to the inverting input of the operational amplifier, which is connected, on the one hand, through a capacitor and a synchronized switch and, on the other hand, through a synchronized switch to the output. The emitter of the transistor is connected through a synchronized switch and a capacitor to the inverting input. In this way, the operational amplifier can operate in preparatory synchronization as voltage follower and the resulting offset voltage can be stored in a capacitor. It is thus possible, before or during the operation of the reference voltage, to automatically compensate the offset voltage.

In further accordance with the invention, it can be provided that the noninverting input of the operational amplifier is connected through a synchronized switch to the emitter of the transistor and to a capacitor connected to common ground. In this way, it is possible to compensate for the offset errors caused by parasitic channel loading of the transistors used as switches.

A better understanding of the features and advantages of the present invention will be obtained by reference to the following detailed description and accompanying drawings which set forth illustrative embodiments in which the concepts of the invention are utilized.

DETAILED DESCRIPTION OF THE INVENTION

Figure 1:
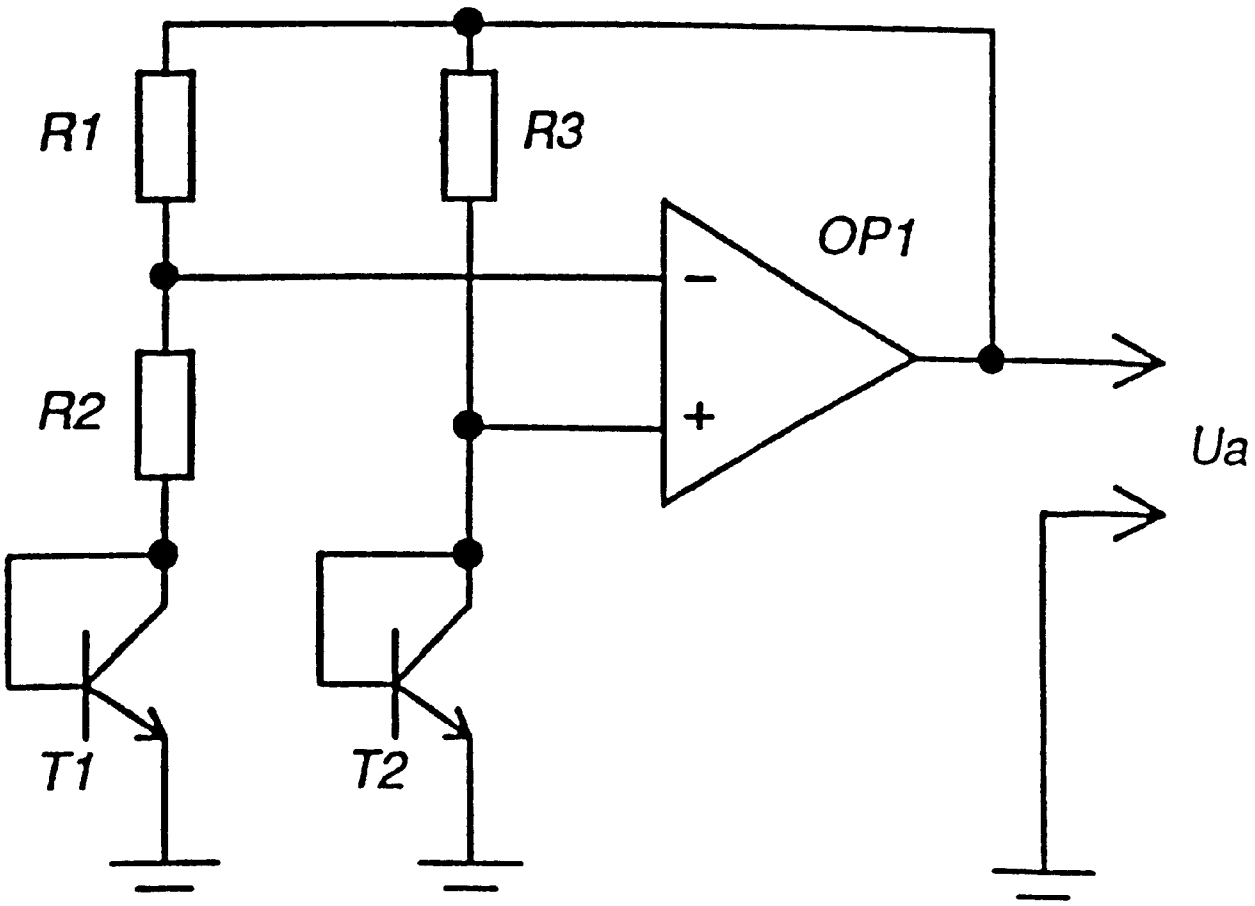
FIG. 1 (PRIOR ART)
FIG. 1 is a schematic drawing illustrating a prior art temperature stabilization circuit.

FIG. 1 shows a circuit configuration for temperature stabilization of a reference voltage, according to the bandgap principle, as it is used in accordance with prior art. In the FIG. 1 circuit, the output voltage Ua of an operational amplifier OP1 is the sum, weighted by the resistors R1 and R2, of the voltage at the base-emitter diode of transistor 2 and the voltage difference of the two base-emitter diodes T1 and T2. The base-emitter diode is generally a diode or a pn junction, which can also be a component of an integrated circuit.

Figure 2:
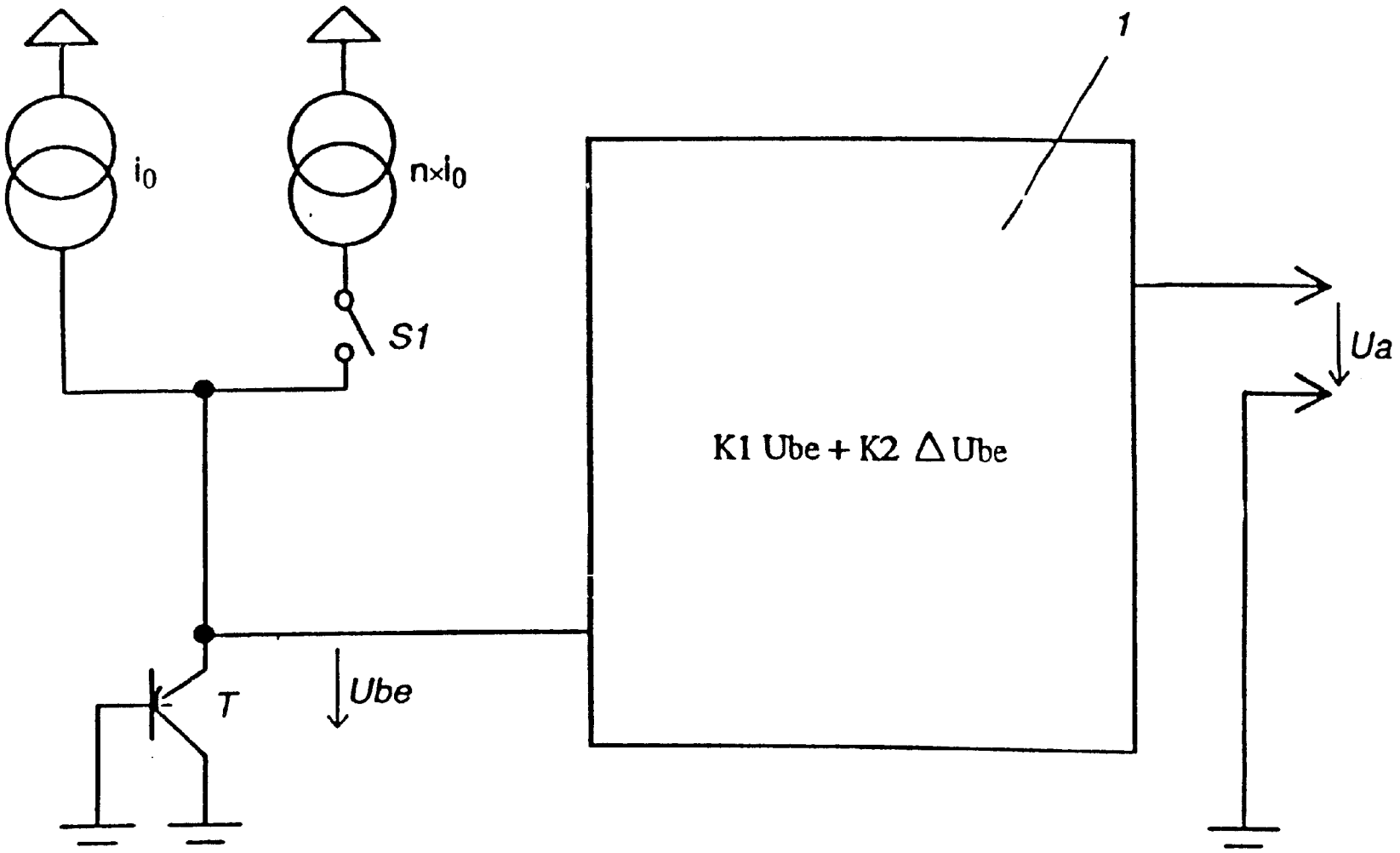
FIG. 2 is a schematic drawing illustrating a temperature stabilization circuit configuration in accordance with the present invention.

FIG. 2 shows a circuit configuration in accordance with the present invention with schematically shown analysis circuit 1. In the FIG. 2 circuit, only one diode or one pn junction, preferably the base-emitter diode of a bipolar transistor T, is provided for, in which, in a first time interval, a current with a first amperage Io and, in a second time interval, a current with a second amperage (n+1) Io, are alternately applied. Here, any value of n can be chosen, but preferably an integral number is chosen (n=1, 2, 3, . . . ). During the first and second time intervals, the voltages at the diode or the pn junction are supplied to the input of the analysis circuit 1, whereby, in the analysis circuit, the difference of the two voltages obtained through the first and second amperages, $DU_{be}$, is formed and is added in a weighted manner to the voltage $U_{be}$ obtained through one of the two amperages. The result is applied to the output of the analysis circuit 1.

To this end, a first current source with the amperage Io and a synchronized second current source that supplies any multiple, preferably an integral multiple, of the current of the first current source (n Io) are connected to a transistor T operating as diode. This circuit junction is connected to the input of the analysis circuit 1, in which the weighted sum and the corresponding output voltage Ua are formed. The synchronized current source is realized in this embodiment through a switch Si that is connected in series with the current source and that opens and closes in synchronized manner. The switch Si is opened during the first time interval and closed during the second time interval, so that, alternately, the first current Io and the second current (n+1) Io flow through the base-emitter diode. The actuation of the switch S1 occurs with a correspondingly high frequency so that the subsequent analysis circuit 1 can fulfill its function. The base-emitter diode of the transistor T is realized by connection of base and collector to common ground. The emitter terminal of the transistor T is connected to the input of the analysis circuit 1.

Figure 3:
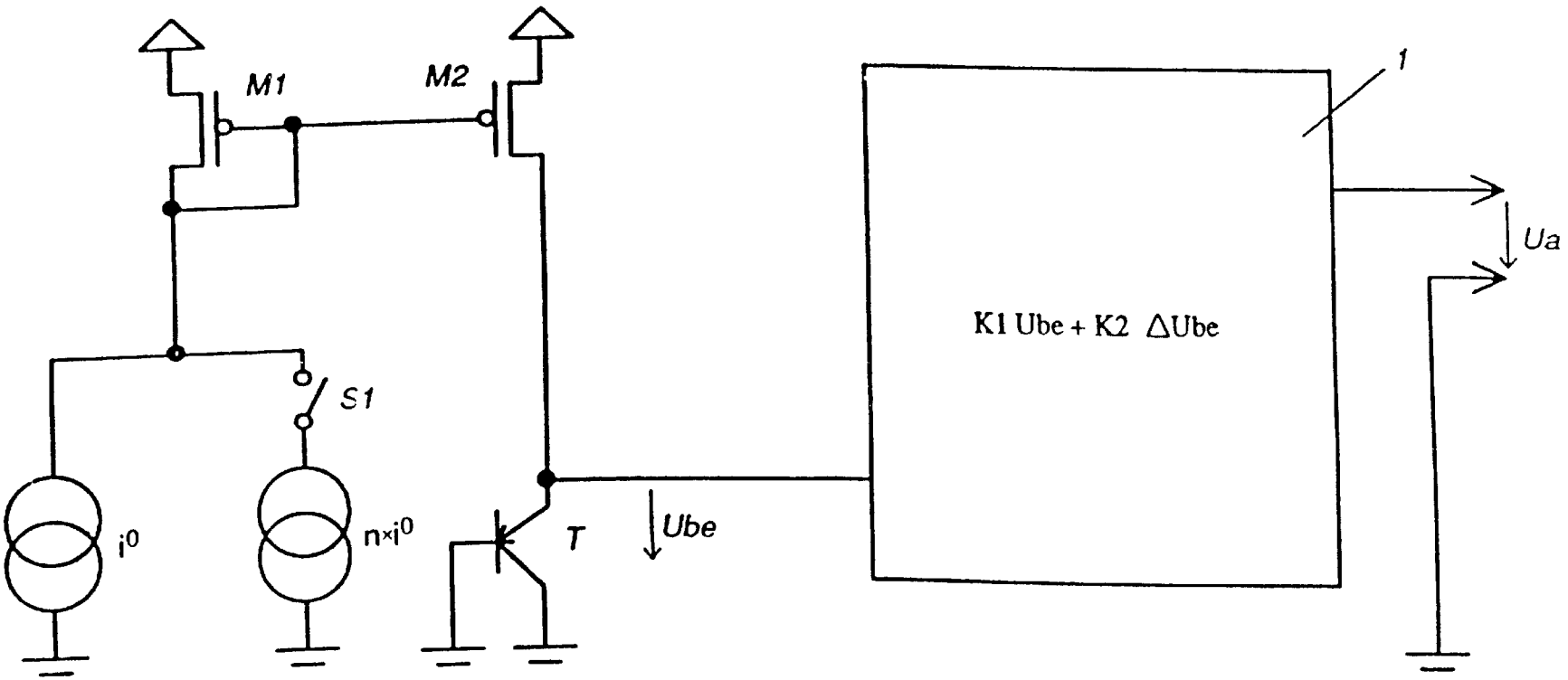
FIG. 3 is a schematic drawing illustrating an alternative embodiment of a temperature stabilization circuit configuration in accordance with the present invention.

Instead of two current sources with two different amperages, it is also possible to provide only one current source, for example a current source having a shunt resistor actuated by a switch, which can thereby likewise apply two different alternating amperages. To this end, a further embodiment of the invention with a current-controlled current source is represented in FIG. 3. The FIG. 3 circuit is realizable with the help of a current level switch with field effect transistors M1, M2 having the same characteristic data. Independent of the amperages and potentials of the current sources Io and nIo, it is thereby possible also to impress very low amperages without the necessity of employing high-ohmic resistors, which are difficult to realize on integrated circuits.

Figure 4:
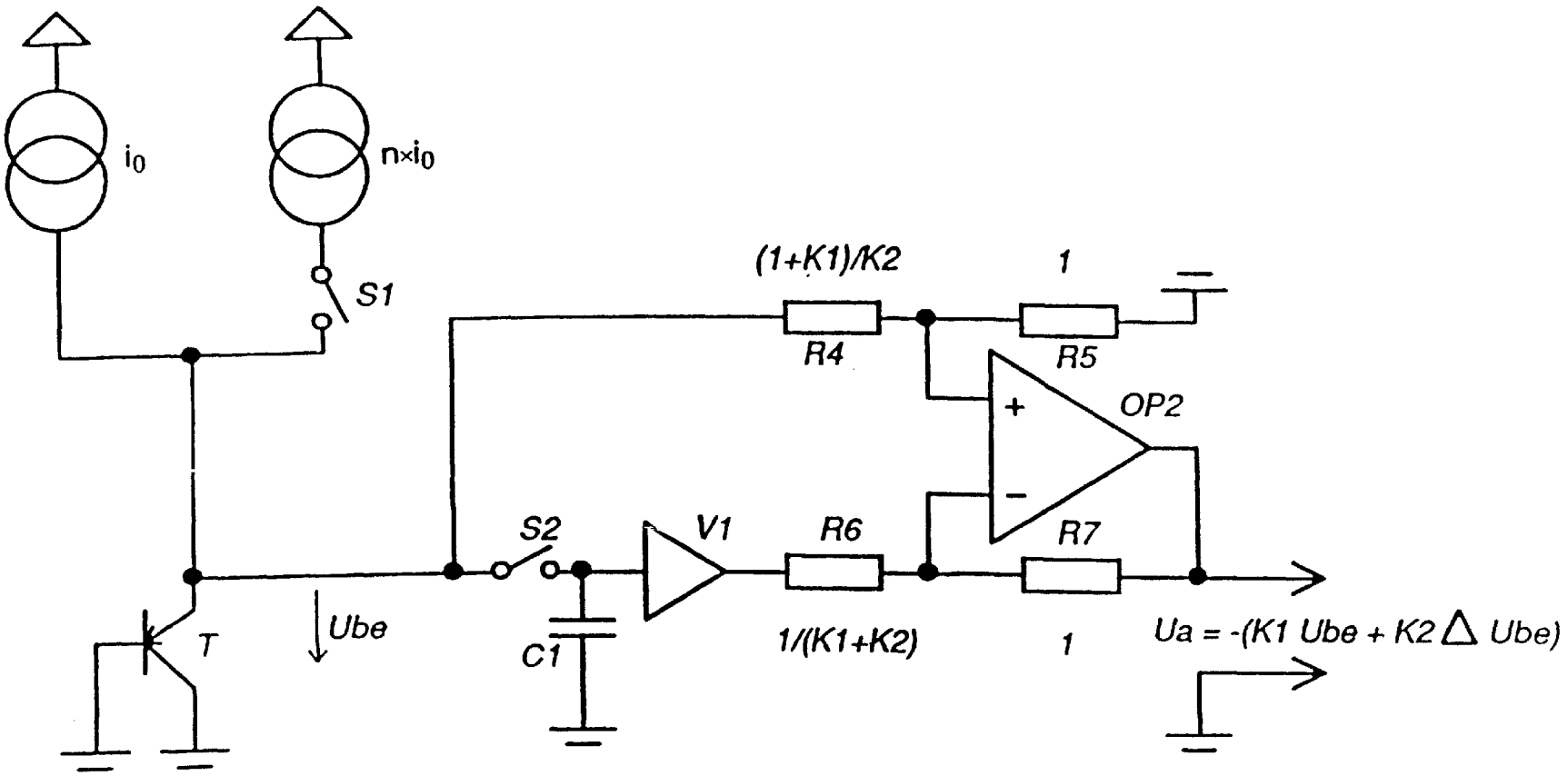
FIG. 4 is a schematic drawing illustrating an embodiment of a temperature stabilization circuit configuration in accordance with the present invention with an analysis circuit.

FIG. 4 shows a variant of the circuit configuration in accordance with the invention with an embodiment of the analysis circuit 1. Here, during one of the time intervals, the voltage that is applied to the base-emitter diode is read and remains stored during the subsequent time interval. For this purpose, the emitter terminal of the transistor T is connected through a synchronized switch S2 to a terminal of a holding capacitor C1 and to the input of a high-ohmic voltage amplifier V1. The voltage applied when the switch is closed is stored in capacitor C1 and amplified through amplifier V1. When switch S2 is opened during the interval of time following the storing time interval, the voltage value at capacitor C1 is retained. The output of amplifier V1 is connected through a resistor R6 to the inverting input of an operational amplifier OP2, which is connected through a resistor R7 to the output of the operational amplifier OP2. Here, the resistors are preferably chosen as resistor R6=1/(K1+K2) and resistor R7=1, whereby K1 and K2 represent the weighting factors already defined above. Furthermore, the synchronized voltage of the base-emitter diode of the transistor T arrives through a resistor R4 directly at the noninverting input, which is connected through a resistor R5 to common ground. Here, the resistors are preferably chosen as resistor R4=(1+K1)/K2 and resistor R5=1, so that, finally, at the output, the voltage $Ua=-(K1\ U_{be}+K2\ DU_{be})$ is attained, which fulfills exactly the desired temperature stability.

Figure 5:
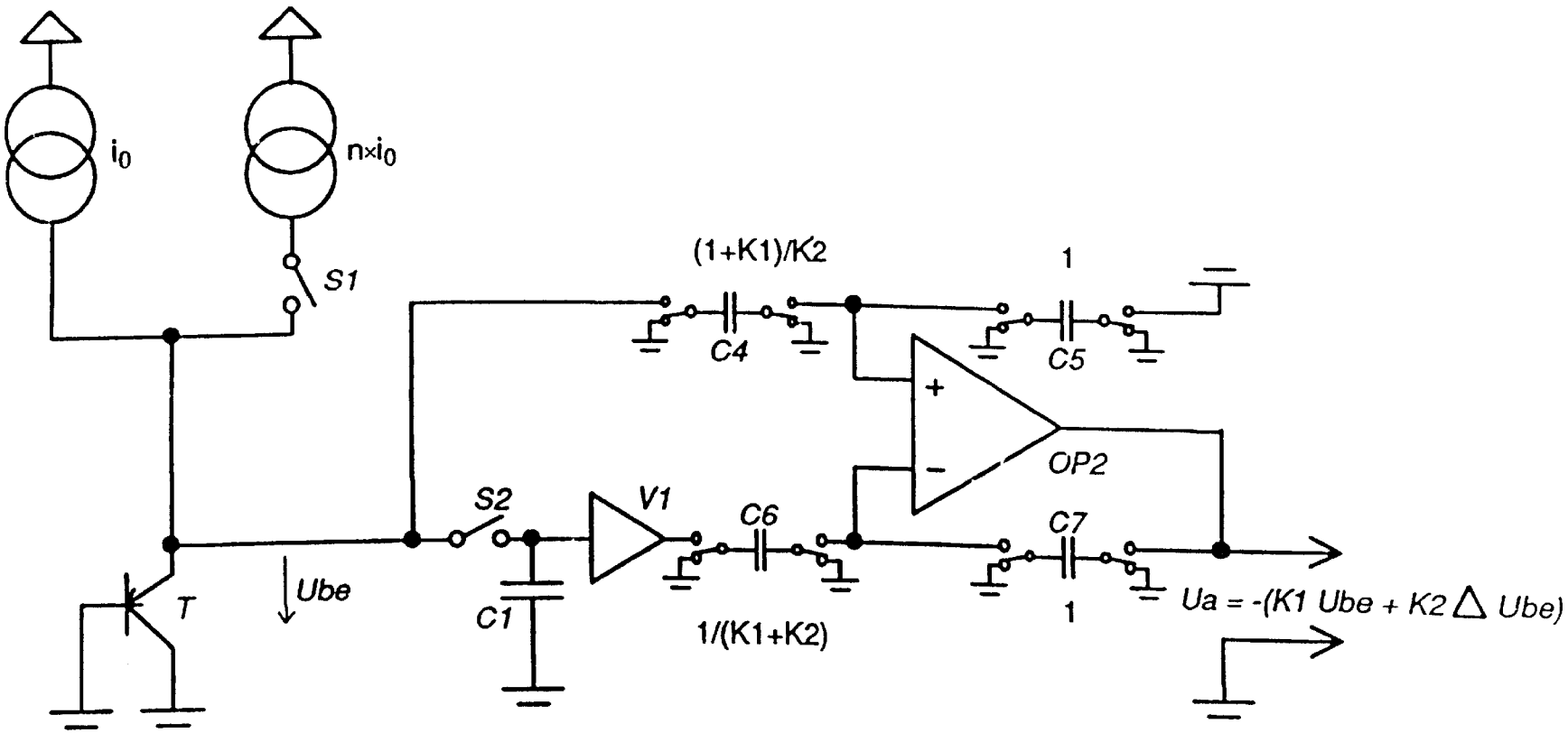
FIG. 5 is a schematic drawing illustrating a further embodiment of a temperature stabilization circuit configuration in accordance with the present invention with an analysis circuit utilizing switched capacitor circuit technology.

FIG. 5 shows a further embodiment of a circuit configuration in accordance with the present invention, in which, for better realization in CMOS technology, the resistors R4, R5, RG, R7 in FIG. 4 are formed by switched capacitors C4, C5, C6, C7 in switched capacitor circuit technology. For a sufficiently high rate of reading, the switched capacitors act like resistors. Since capacitors can be fabricated with a much higher accuracy in CMOS technology, it is possible to increase the accuracy of the temperature stabilization in a corresponding manner by employing these switched capacitors. The amount of resistance results from the reading frequency and the capacitance used.

Figure 6:
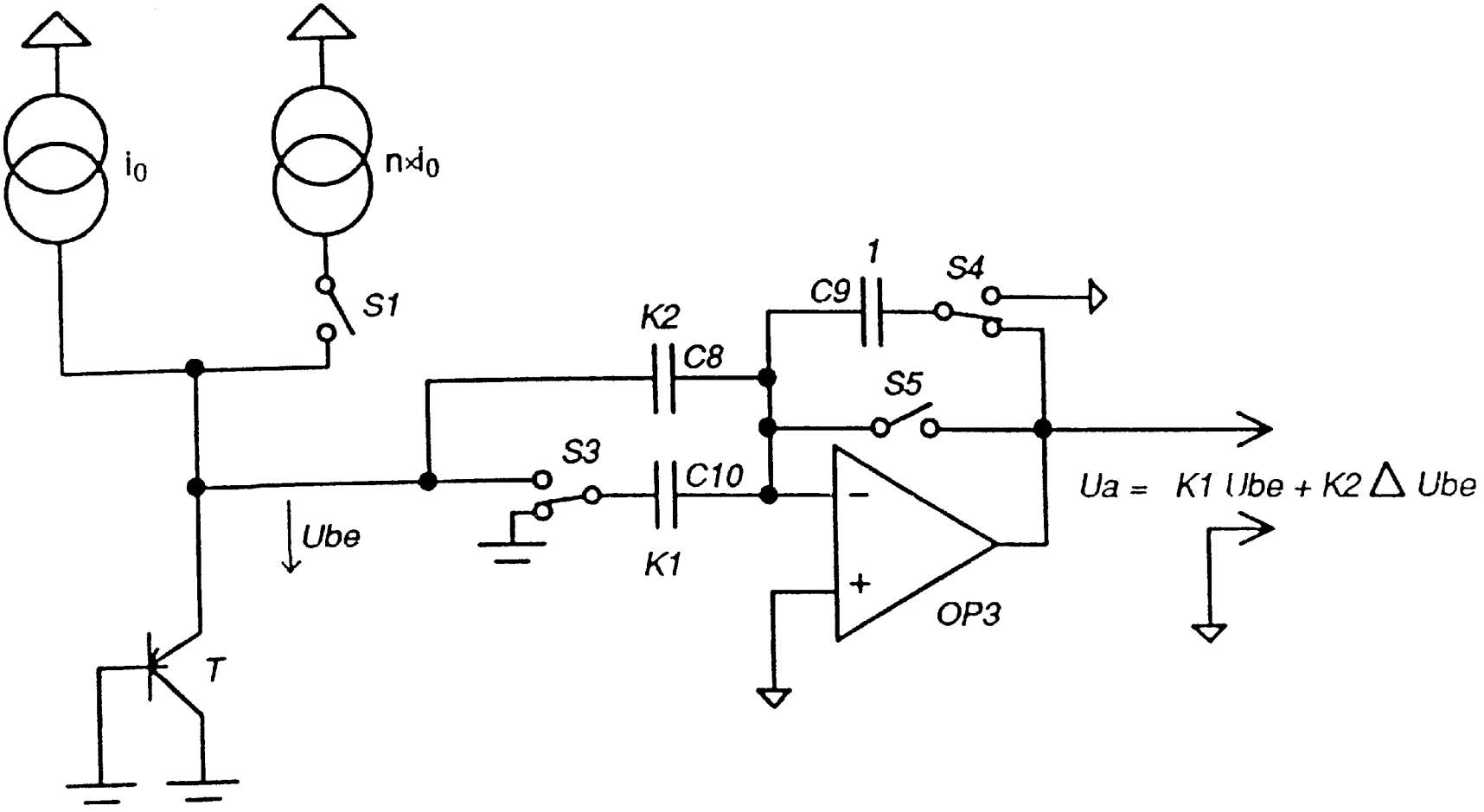
FIG. 6 is a schematic drawing illustrating an embodiment of a temperature stabilization circuit configuration in accordance with the present invention with offset compensation.

FIG. 6 shows a further variant of the analysis circuit 1 in accordance with the invention, in which the offset voltage of the operational amplifier used is compensated for by operating the operational amplifier as a voltage follower during a preparatory synchronization phase and by storing the offset voltage thus generated in one or more capacitors as charge. Here, the emitter of the transistor T, which is connected to the two current sources Io and nIo, is connected through a capacitor C8 to the inverting input of the operational amplifier OP3, which is connected, on the one hand, via a capacitor C9 and a synchronized switch S4 and, on the other hand, through a synchronized switch S5 to the output. Further, the emitter of the transistor T is connected through a synchronized switch S3 and a capacitor C10 to the inverting input.

Figure 7:
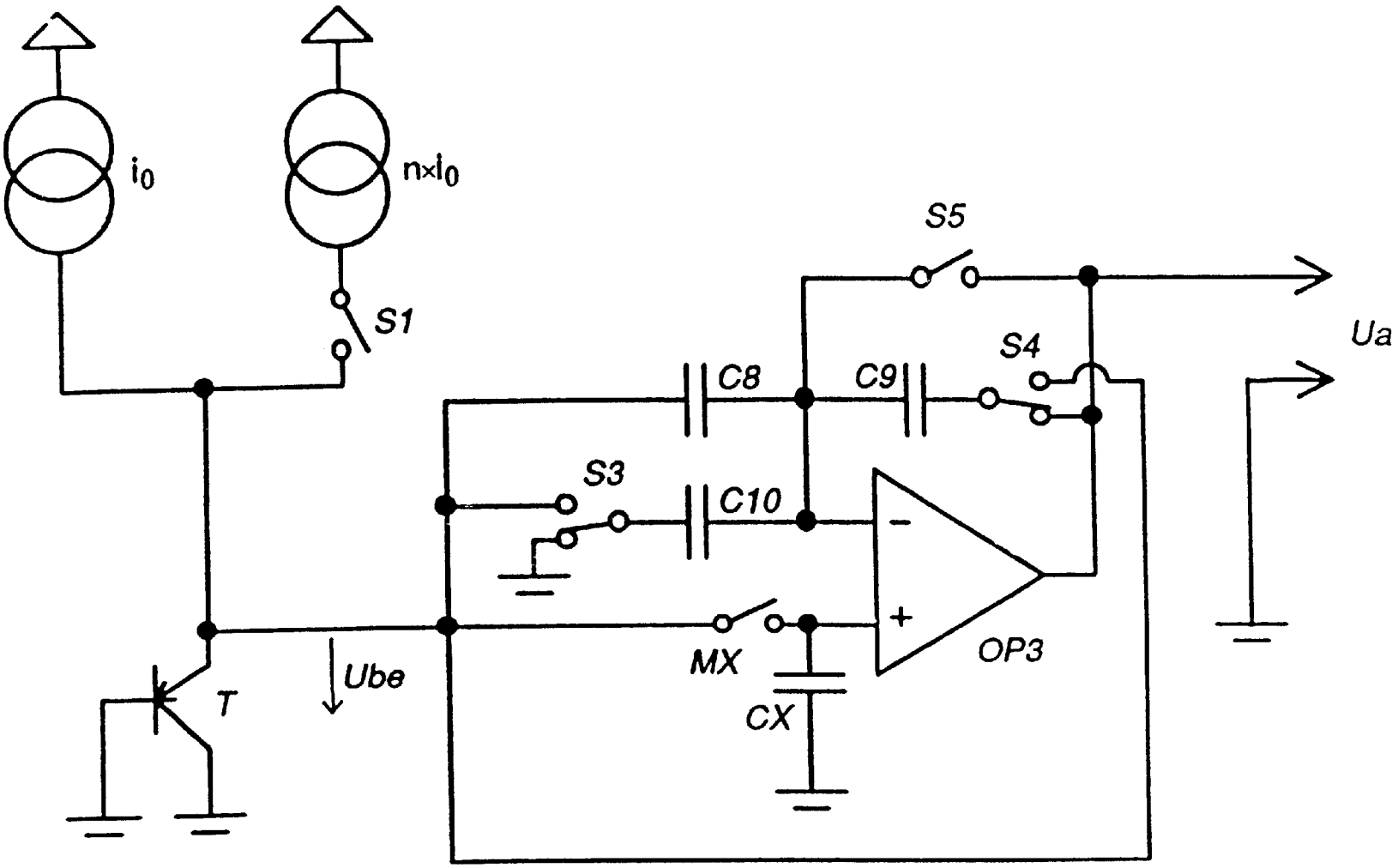
FIG. 7 is a schematic drawing illustrating an embodiment of a temperature stabilization circuit configuration in accordance with the present invention for the compensation of parasitic channel loading.

FIG. 7 shows a further embodiment of a circuit configuration in accordance with the invention, in which the offset errors at the input of the operational amplifier caused by the parasitic channel loading of the switching transistors are compensated for by a corresponding circuit arrangement at the other input of the operational amplifier. Here, the noninverting input of the operational amplifier OP3 is connected through a synchronized switch MX to the emitter of the transistor T and to the capacitor CX connected to common ground.

It should be understood that various alternatives to the embodiments of the invention described herein may be employed in practicing the invention. It is intended that the following claims define the scope of the invention and that circuits and methods within the scope of these claims and their equivalents be covered thereby.

We claim:

1. A method of temperature stabilization of a reference voltage wherein, in a first prespecified time interval, a first current having a first constant amperage is applied to a pn junction, and in a second prespecified time interval, both the first current and a second current having a second constant amperage are applied to the pn junction, and wherein, during the first and second time intervals, first and second voltages respectively generated at the pn junction are provided to an input at an analysis circuit such that, in the analysis circuit, the difference between the first and second voltages is formed and added in a weighted manner to a voltage obtained through one of the first and second amperages to provide a weighted result that is provided as an output of the analysis circuit, and wherein the analysis circuit includes an operational amplifier for weighted addition, and further comprising operating the operational amplifier during a preparatory synchronization step to generate an offset compensation voltage and storing the offset compensation voltage in at least one capacitor.

2. A temperature stabilization circuit, the circuit comprising:

a first current source that applies a first current having a first constant amperage to a pn junction in a first prespecified time interval to develop a first voltage at the pn junction;

a second current source that applies a second current having a second constant amperage to the pn junction in a second prespecified time interval, the first current also being applied to the pn junction during the second time interval to develop a second voltage at the pn junction;

an analysis circuit that determines a difference between the first and second voltages and for providing the difference as an output of the analysis circuit, and wherein the analysis circuit includes an operational amplifier for weighted addition of the first and second voltages, the operational amplifier being operable as a voltage follower for generating an offset voltage that is stored in at least one capacitor.

3. A temperature stabilization circuit as in claim 2, and wherein the second constant amperage is a multiple of the first constant amperage.

4. A temperature stabilization circuit as in claim 3, and wherein the second constant amperage is an integer multiple of the first constant amperage.

5. A temperature stabilization circuit as in claim 4, and wherein the first and second current sources are connected in series via a first synchronized switch.

6. A temperature stabilization circuit as in claim 2, and wherein the pn junction comprises a base-emitter diode of a bipolar transistor, and wherein the emitter terminal of the bipolar transistor is connected via a second synchronized switch to a terminal of a holding capacitor.

7. A temperature stabilization circuit as in claim 6, and wherein the emitter terminal of the bipolar transistor is further connected to an input of a high-ohmic voltage amplifier, an output of the high-ohmic voltage amplifier being connected via a first resister to an inverting input of an operational amplifier and via a second resister to an output of the operational amplifier, the emitter terminal of the bipolar transistor being further connected through a third resister to a noninverting input of the operational amplifier, the noninverting input being connected via a fourth resister to common ground.

* * * * *

UNITED STATES PATENT AND TRADEMARK OFFICE

CERTIFICATE OF CORRECTION

PATENT NO.: 5,945,871
DATED: August 31, 1999
INVENTOR(S): WILFRIED KAUSEL et al.

It is certified that errors appear in the above-identified patent and that said Letters Patent is hereby corrected as shown below:

In Col. 6, line 46, delete "emitter".

In Col. 6, line 46, delete "bipolar transistor" and replace with --holding capacitor--.

In Col. 6, line 49, delete "resister" and replace with --resistor--.

In Col. 6, line 50, delete "resister" and replace with --resistor--.

In Col. 6, line 53, delete "resister" and replace with --resistor--.

In Col. 6, line 54, delete "resister" and replace with --resistor--.

Signed and Sealed this
First Day of February, 2000

*Attest:*

Q. TODD DICKINSON

*Attesting Officer*

*Acting Commissioner of Patents and Trademarks*